United States Patent [19]

Powers

[11] 4,128,253

[45] Dec. 5, 1978

[54] PALLET AND ROLLER POST CONSTRUCTION THEREFOR

[76] Inventor: Richard J. Powers, 4340 N. Marmora, Chicago, Ill. 60610

[21] Appl. No.: 842,055

[22] Filed: Oct. 14, 1977

[51] Int. Cl.[2] ..... B62B 1/00; B65D 19/26; B65D 19/42

[52] U.S. Cl. ..... 280/79.1 A; 108/55.1; 108/56.1

[58] Field of Search ..... 108/51.1–57.1, 108/901, 902; 214/10.5 R; 206/386, 599, 600; 248/346; 85/39; 280/79.1 R, 79.1 A

[56] References Cited

U.S. PATENT DOCUMENTS

| | | | |
|---|---|---|---|
| 2,918,241 | 12/1959 | Maher | 108/56.1 |
| 3,148,637 | 9/1964 | Lund | 108/53.1 |
| 3,199,469 | 8/1965 | Sullivan | 108/53.3 |
| 3,277,847 | 10/1966 | Jensen | 108/56.1 |
| 3,438,342 | 4/1969 | Woolworth et al. | 108/56.3 |
| 4,019,634 | 4/1977 | Bonnot | 108/53.3 X |

FOREIGN PATENT DOCUMENTS

| | | | |
|---|---|---|---|
| 588878 | 2/1959 | Italy | 108/55.1 |
| 204377 | 5/1966 | Sweden | 85/7 |
| 934005 | 8/1963 | United Kingdom | 108/57.1 |
| 1325302 | 8/1973 | United Kingdom | 85/7 |
| 1454882 | 11/1976 | United Kingdom | 108/51.1 |

*Primary Examiner*—Roy D. Frazier
*Assistant Examiner*—William E. Lyddane
*Attorney, Agent, or Firm*—Knechtel, Valentino, Demeur & Dallas

[57] ABSTRACT

An improved pallet and, particularly, an improved post construction for a pallet which can be easily and quickly affixed thereto. In addition, a roller is provided about the posts for reducing the tendency of fork tines from damaging or otherwise impairing the posts.

27 Claims, 12 Drawing Figures

FIG. 1
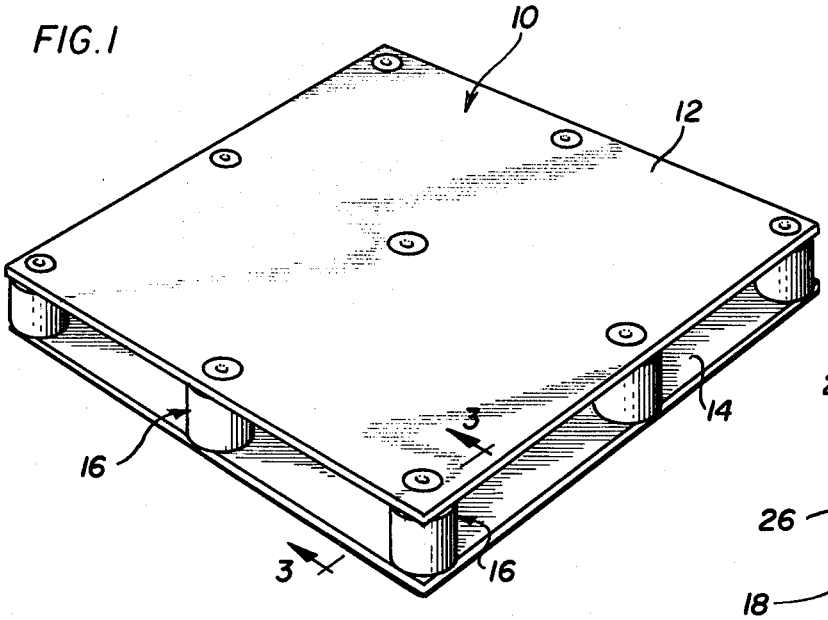
FIG. 2
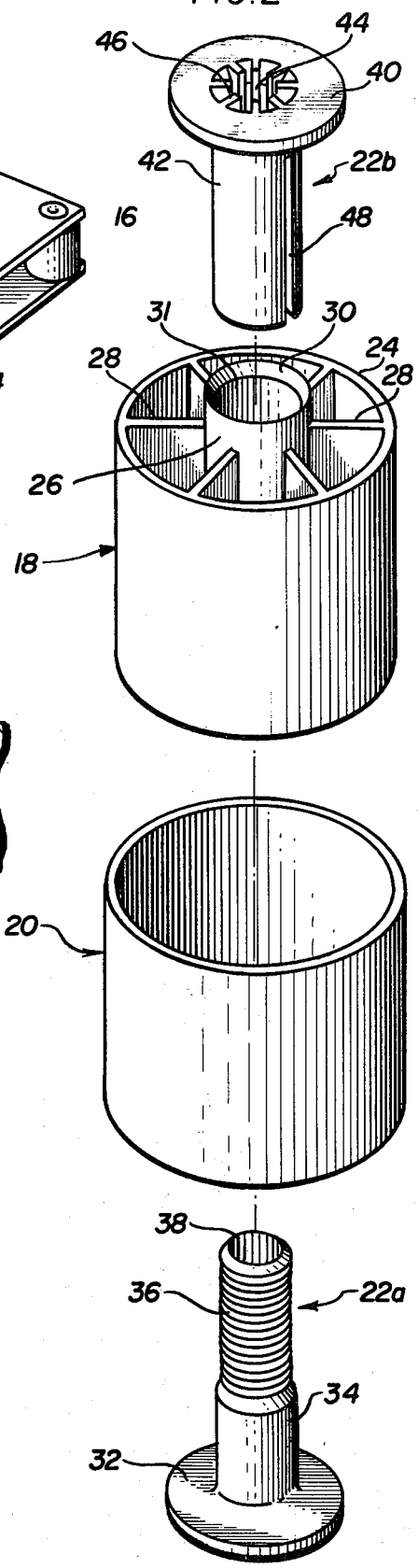
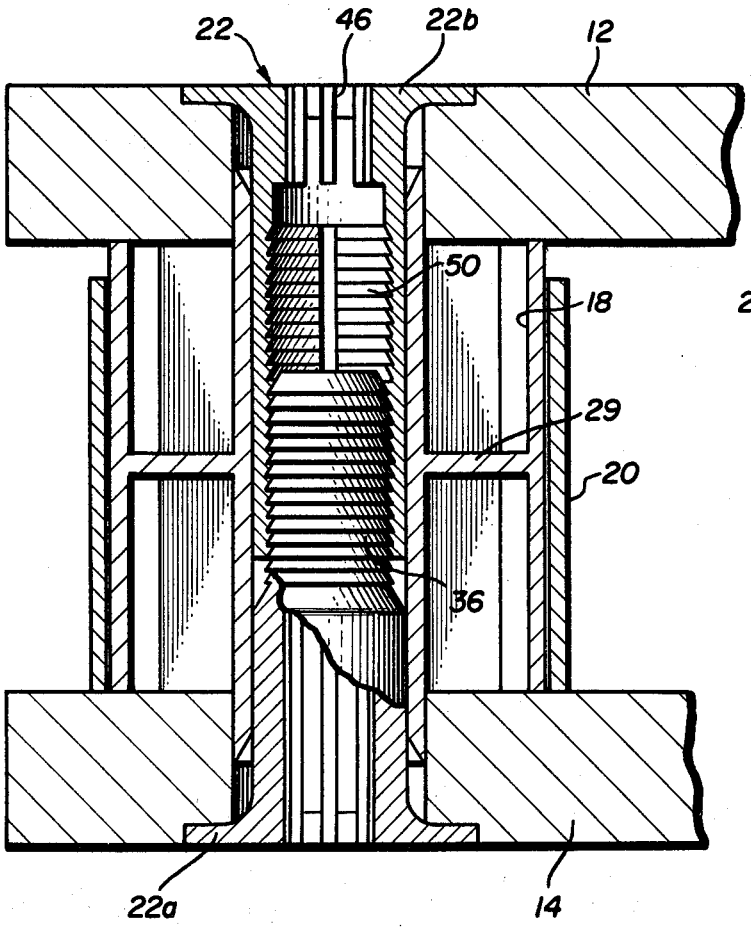
FIG. 3

PALLET AND ROLLER POST CONSTRUCTION THEREFOR

The present invention relates, generally, to an improved pallet and, more particularly, to an improved roller post construction for use in conjunction with pallets of various sorts.

The present invention provides a pallet which is more readily adapted to handling by forklifts and other lifting devices in confined spaces, and which has a greater increased service life. Further still, the invention provides a pallet having at least an upper platform, to which is affixed a plurality of posts for supporting the upper platform in spaced relationship to a support surface such as a floor or, alternatively, to which is affixed a plurality of roller post assemblies, which both support the upper platform in spaced relationship to a support surface such as a floor, and which tend to deflect the tines of a forklift truck so that they properly penetrate under the upper platform, so that any tendency of the fork tines to damage or otherwise impair the roller posts is greatly reduced by the rollers absorbing the impact and rotating to direct the tines into the throat area.

The pallet, furthermore, can comprise only a single upper platform or, alternatively, the pallet can comprise an upper and a lower platform which are disposed in spaced apart relationship by means of a plurality of roller post assemblies secured between them. Further still, the construction of the roller post assemblies is such that a walled container having post means on the bottom wall thereof can be removably secured to the pallet in a fashion such as to substantially eliminate the tendency for such walled containers to be inadvertently dislodged from the pallet during lifting and/or transporting a pallet with such a walled container seated thereon. The construction of the pallet and/or roller post assemblies also is such that casters can be easily and removably affixed to the pallet.

Accordingly, it is an object of the present invention to provide an improved pallet which is more readily adapted to handling by forklifts and other lifting devices in confined spaces, and which has a greater increased service life.

a further object of the invention is to provide a pallet having an improved post construction, which posts support the upper and lower platforms of a pallet in spaced apart relationship to provide a throat area in which the fork tines of a forklift truck, for example, can be inserted for lifting and transporting the pallet. In this respect, the improved posts can be simply affixed to an upper platform to support the latter in spaced apart relationship with a support surface such as a floor to provide a throat area between the floor and the upper platform into which the fork tines of a forklift truck can be inserted to lift and/or transport the pallet. A pallet of the latter described construction is generally termed a "slip sheet".

A still further object is to provide a pallet having an improved roller post construction, the latter being such that the roller posts can be easily and quickly affixed to the pallet.

The above objects and features of the pallet and the pallet posts and/or pallet roller post assemblies can be better understood from the description below, taken in conjunction with the following drawings.

BRIEF DESCRIPTION OF THE DRAWINGS

FIG. 1 is a perspective view exemplary of a pallet constructed in accordance with the present invention;

FIG. 2 is an exploded perspective view of one of the roller post assemblies;

FIG. 3 is a sectional view taken generally along lines 3—3 of FIG. 1;

DESCRIPTION OF A PREFERRED EMBODIMENT OF THE INVENTION

Figure 4:
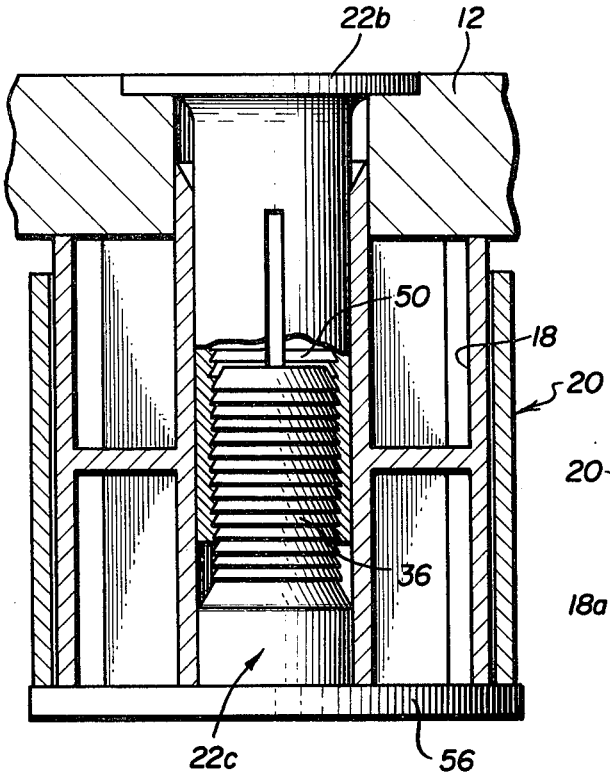
FIG. 4 is a partial sectional view illustrating a roller post assembly constructed in accordance with a second embodiment of the invention.

Referring now to the drawings, in FIG. 1 there is illustrated a pallet 10 having an upper platform 12 and a lower platform 14 secured together in spaced apart relationship by means of a plurality of roller post assemblies 16. The upper platform 12 and lower platform 14 may be of any suitable material such as wood, plywood, pressboard or the like. In the embodiment illustrated in FIG. 1, there are nine roller post assemblies 16 secured between the upper platform 12 and the lower platform 14, however, a lesser number of roller post assemblies 16 could be used, depending upon the surface area of the platforms and the strength thereof.

As can be best seen in FIGS. 2 and 3, each of the roller post assemblies 16 comprises a spacer 18, a roller 20, and a rivet 22, comprising a male rivet portion **22*a* and a female rivet portion 22*b*. The entire roller post assembly 16 preferably and advantageously can be inexpensively molded of plastic, and the construction of the roller post assemblies 16** is such that it can be easily and quickly affixed to the pallet.

More particularly, the spacer 18 of the roller post assemblies 16 has an outer cylindrical body 24 and an inner cylindrical body 26 which is axially disposed and supported therein by means of a plurality of radial extending support flanges 28 and a horizontal divider and support 29 (FIG. 3). The inner body 26 has a bore 31 extending through it for receiving therein the rivet 22, as more fully described below. The length of the inner body 26 also is greater than the length of the outer body 24, for reasons which will be more apparent from the description below. Further still, the opposite terminal edges of the inner body 26 preferably and advantageously can be tapered as at 30 to provide a camming type surface for guiding the rivet 22 into the bore 31 in the inner body 26.

The roller 20 of the roller post assemblies 16 is simply a hollow cylindrical member having an inner diameter just slightly larger than the outer diameter of the cylindrical outer body 24 of the spacer 18, so that when assembled, the roller 20 can freely rotate about the spacer 18. Also, the length of the roller 20 is somewhat less than the length of the outer cylindrical body 24 of the spacer 18 so that the roller 20 is freely retained about the spacer 18 when the roller post assemblies 16 are affixed to the upper platform 12 and the lower platform 14 of the pallet 10, as illustrated in FIG. 3.

The male rivet portion **22*a* of the rivet 22 has an enlarged diameter disc shaped base portion 32 and a cylindrical shaft portion 34 integrally formed therewith. The cylindrical shaft portion 34 has interlocking means 36 formed thereon. A bore 38 also extends through the cylindrical shaft portion 34 and the base portion 32**.

The female rivet portion **22*b* likewise comprises an enlarged diameter disc shaped base portion 40 having a cylindrical shaft portion 42 integrally formed therewith. A bore 44 extends through the base portion 40 and the cylindrical shaft portion 42, and the walls of the bore 44 are provided with interlocking means 50, as can be best seen in FIG. 3. A pair of diametrically opposed slots 48 preferably and advantageously are formed in the cylindrical shaft portion 42, for reasons described more fully below. A plurality of inwardly extending radially disposed flanges 46 can be provided within the bores 38 and 44 to provide additional strength for the rivets 22**, if desired.

The interlocking means 36 of the male rivet portion **22*a* and the interlocking means 50 of the female rivet portion 22*b* are complimentary interlocking means which lockingly engage to secure the male rivet portion 22*a* and the female rivet portion 22*b* together when the rivet 22 is assembled by extending the cylindrical shaft portion 34 into the bore 44**.

The interlocking means 36 and 50 can be, for example, a plurality of barbs formed on the respective members which lockingly engage to prevent the rivet from subsequently separating. Alternatively, the interlocking means can be threads formed on the respective members so that the rivet 22 can be threadedly secured together. Irrespective of the type of interlocking means used, preferably and advantageously the interlocking means are such that the male rivet portion **22*a* and the female rivet portion 22*b* can be quickly and easily affixed together by simply forcibly inserting the cylindrical shaft portion 34 into the bore 44 of the female rivet portion 22*b*. In this respect, the slots 48 in the walls of the cylindrical shaft portion 42 of the female rivet portion 22*b* provides sufficient flexibilty during assembly to permit the cylindrical shaft portion 34 to be forcibly inserted into the bore 34. Once assembled, the interlocking means 36 and 50 lockingly engage to prevent the rivet 22** from subsequently separating.

In constructing the pallet 10, holes corresponding in number to the roller post assemblies 16 to be affixed to the pallet 10, are formed in each the upper platform 12 and the lower platform 14. The holes formed in the platforms 12 and 14 obviously must be in alignment with one another, and the diameter of these holes preferably and advantageously substantially correspond to the diameter of the outside diameter of the inner body 26 of the spacer 18, so that the extended portion of the inner body 26 is snugly received within the holes formed in the platforms 12 and 14, as illustrated in FIG. 3. Also, preferably and advantageously, countersunk holes are provided in the platforms 12 and 14 for receiving therein the base portions 32 and 40 of the male rivet portion **22*a* and female rivet portion 22*b*, as illustrated in FIG. 3, so that ultimately these base portions are flush with the surfaces of the platforms 12 and 14, so that there are no projections above the surface of the platforms 12 and 14**.

As can be seen in FIG. 3, the spacers 18 are disposed between the upper platform 12 and the lower platform 14, with the extended portions of the inner body 26 projecting into the holes formed in the platforms 12 and 14, with the roller 20 rotatably disposed about the spacer 18. The upper platform 12 and the lower platform 14 are fixedly secured to the roller post assemblies 16 and the latter fixedly secured between the upper platform 12 and the lower platform 14 by extending the cylindrical shaft portion 34 and the cylindrical shaft portion 42 of the male rivet portion **22*a* and the female rivet portion 22*b* through the holes in the platforms 12 and 14 into the bore 31 in the inner body 26 of the spacer 18. As can be seen in FIG. 3, the outer diameter of the cylindrical shaft portion 42 of the female rivet portion 22*b* substantially corresponds with the inner diameter of the bore 31 in the inner body 26 of the spacer 18, so that the cylindrical shaft portion 42 is freely but snugly received within the bore 31. The diameter of the cylindrical shaft portion 34 of the male rivet portion 22*a* substantially corresponds to the diameter of the bore 44 in the female rivet portion 22*b* so that the interlocking means 36 and 50 on the respective rivet halves lockingly engage when the male rivet portion 22*a* and the female rivet portion 22*b* are forcibly urged together. The latter can be accomplished by, for example, by pressing or hammering one or the other of the male rivet portion 22*a* and female rivet portion 22*b* to forcibly urge the cylindrical shaft portion 34 into the bore 44**.

In FIG. 4, there is illustrated a roller post assembly which is generally like the roller post assemblies 16, however, in this case the roller post assembly is adapted to permit it to be affixed to only an upper platform 12. In this case, the male rivet portion **22*c* has an enlarged diameter base portion 56, the diameter thereof being greater than the diameter of the roller 20, so that the latter is retained on and about the spacer 18 by means of the enlarged diameter base portion 56. Otherwise, the construction of the roller post assembly is the same, and the roller post assembly is affixed to the upper platform 12** in the same fashion.

Figure 5:
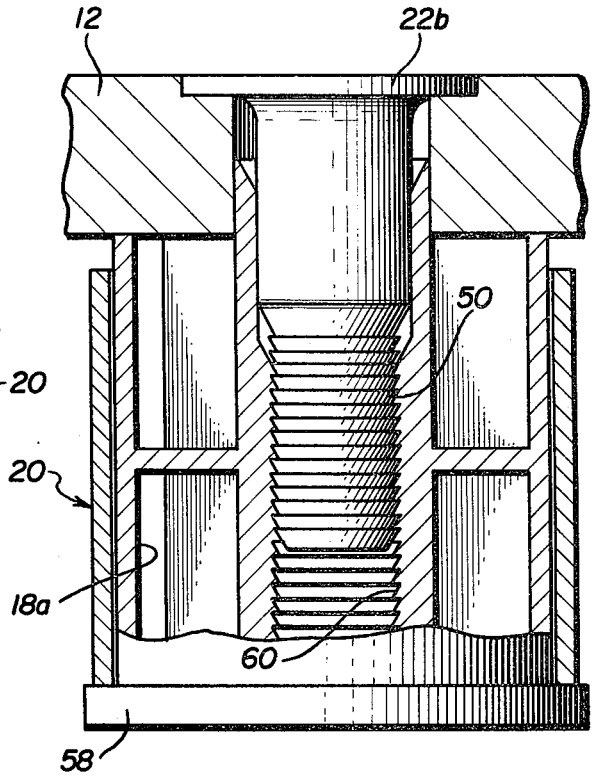
FIG. 5 is a partial sectional view illustrating a roller post assembly constructed in accordance with still another embodiment of the invention.

In FIG. 5, there is illustrated still another roller post assembly which, like the roller post assembly disclosed in FIG. 4, is adapted to be affixed to only an upper platform 12. In this case, the spacer 18 is provided with an enlarged diameter base portion 58 which is larger in diameter than the diameter of the roller 20, so that the roller 20 is retained on and about the spacer 18 by means of the enlarged diameter base portion 58. In this case also, the bore 31 in the inner body 26 of the spacer 18 is formed and has interlocking means 60 provided thereon, so that the interlocking means 50 on the cylindrical shaft portion 34 of the male rivet portion 22*a* are forcefully and lockingly engaged with the interlocking means 60 when the male rivet portion 22*a* is forcibly inserted into the bore 31.

Figure 6:
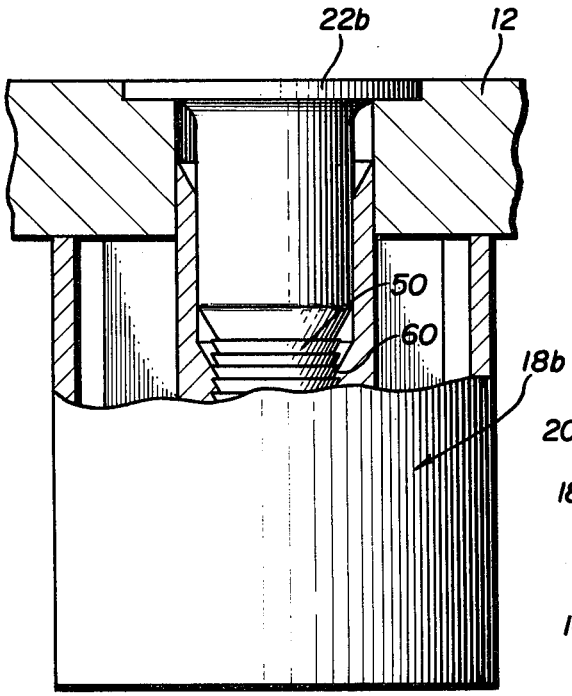
FIG. 6 is a partial sectional view generally illustrating a pallet post and the manner in which it is affixed to a pallet.

In FIG. 6, the arrangement disclosed is substantially like the assembly shown in FIG. 5, however, in this case, only a spacer 18*b* is affixed to an upper platform 12. The enlarged diameter base portion 58, illustrated in FIG. 5, is eliminated, since there is no roller 20 to be retained and rotatably supported about the spacer 18*b*. Obviously, however, a very similar construction can be provided simply by affixing a spacer 18*a*, as illustrated in FIG. 5, to the upper platform 12 and eliminating the roller 20. In either case, as indicated above, the resulting pallet is generally termed a "slip sheet".

Figure 7:
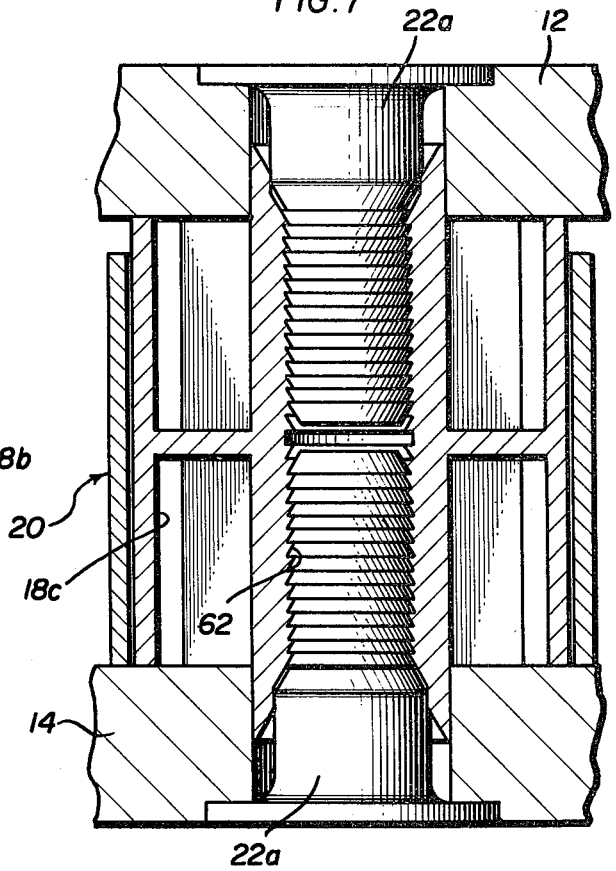
FIG. 7 is a partial sectional view illustrating a roller post assembly constructed in accordance with still another embodiment of the invention.

In FIG. 7, there is illustrated still another roller post assembly which is adapted to be affixed between an upper platform 12 and a lower platform 14. In this case, two male rivet portions 22*a* are used, and the bore 31 in the spacer 18 is formed and provided with interlocking means 62 for lockingly engaging with the male rivet portions 22*a* when the cylindrical shaft portions 34 thereof are forcibly inserted into the bore 31. Otherwise, the construction and the assembly of the roller post assembly is the same as described above.

Figure 8:
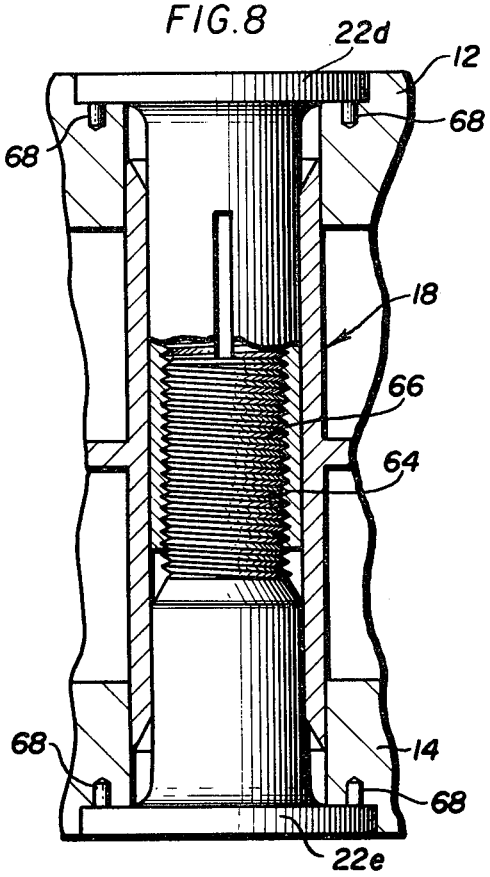
FIG. 8 is a partial sectional view generally illustrating a roller post assembly constructed in accordance with still another embodiment of the invention.
Figure 9:
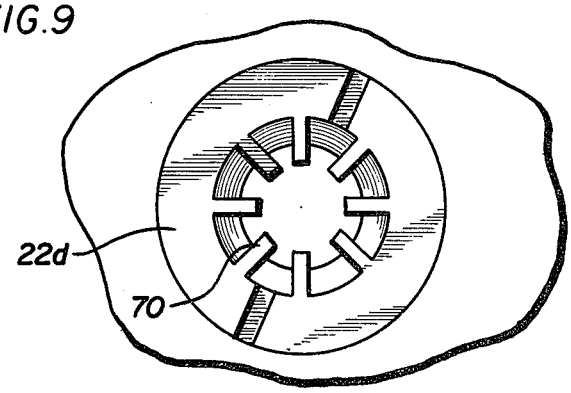
FIG. 9 is a partial top plan view of the roller post assembly of FIG. 8, generally illustrating the tool slots formed in the upper and/or lower rivets of the roller post assembly to permit the rivets thereof to be threadedly removed.

In FIG. 8, there is illustrated still another roller post assembly which is adapted to be affixed between an upper platform 12 and a lower platform 14, by means of a male rivet portion 22*a* and a female rivet portion 22*b*. In this case, the interlocking means 36 and 50 provided thereon are in the form of complimentary threads so that the rivet portions 22*a* and 22*b* can be subsequently threadedly disengaged to replace a damaged roller and/or spacer, should the need arise.

With such a construction as shown in FIG. 8, the base portions of the rivet portions 22*e* and 22*d* preferably and advantageously are provided with a plurality of depending pins 68 which are frangible, and the terminal ends of the rivet portions 22*e* and 22*d* are provided with a plurality of slots 70 for accepting a tool for threadedly disengaging the rivet portions 22*e* and 22*d*. In assembling the pallet, the rivet portions 22*e* and 22*d* are interlockingly engaged, in the manner described above, by pushing or hammering them to forcibly urge the cylindrical shaft portion of the one rivet portion into the bore of the other rivet portion to lockingly engage the interlock means. The pins 68 have sufficient strength to penetrate the upper platform 12 and the lower platform 14 during assembly, and these pins 68 being imbedded in the material of the upper platform 12 and the lower platform 14 effectively prevent the rivet portions 22*e* and 22*d* from threadedly disengaging. However, the pins 68 are frangible and can be severed by inserting an appropriate tool in the slots 70 and rotating the rivet portions 22*e* and 22*d* with respect to one another, to threadedly disengage them.

Figure 10:
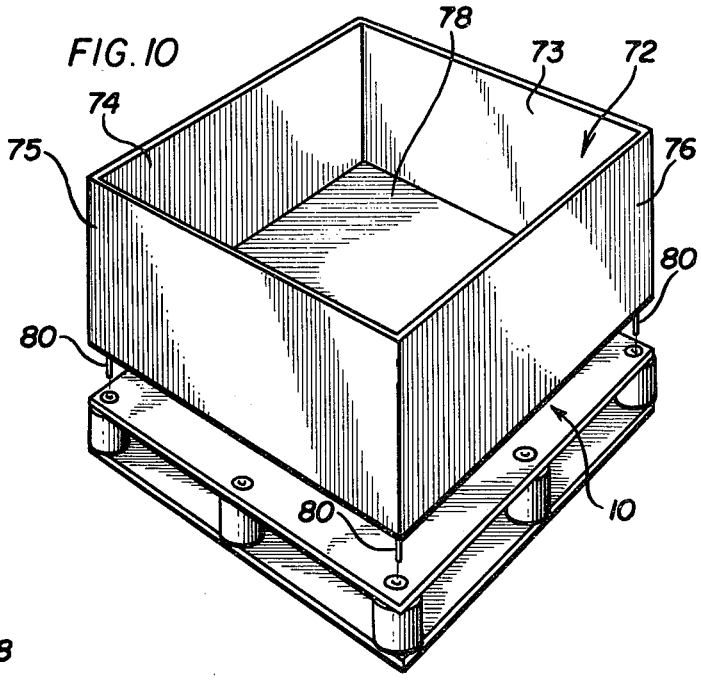
FIG. 10 is a perspective view generally illustrating the manner in which a walled container is removably affixed to a pallet constructed in accordance with the present invention.
Figure 11:
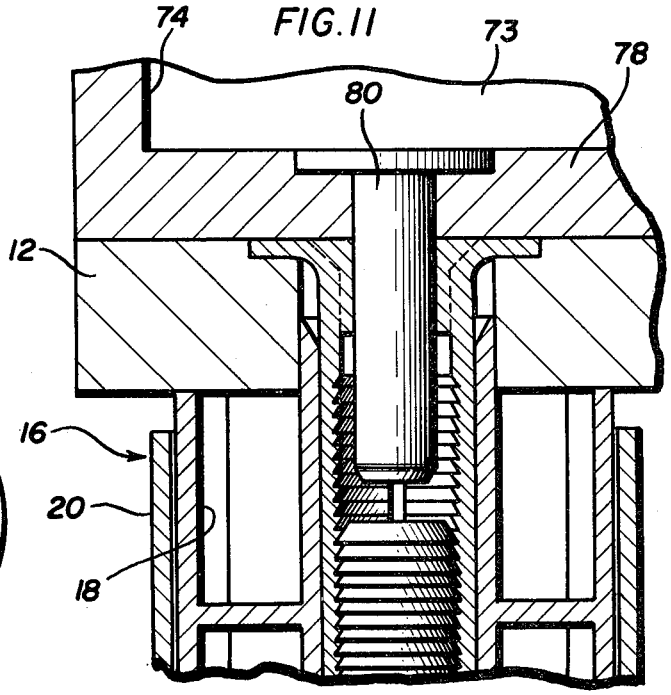
FIG. 11 is a partial sectional view of the assembly of FIG. 10, generally illustrating the manner in which the walled container is retained on the pallet.

In FIG. 10, there is illustrated a pallet 10 which can be constructed in accordance with any one of the above described embodiments of the invention, with a walled container or box 72 adapted to be seated and retained on the pallet, in a fashion such that it is restrained from being inadvertently dislodged from the pallet during lifting or transporting of the pallet. The walled container or box 72 has side walls 74–76 and a bottom wall 78. As can be best seen in FIGS. 10 and 11, the bottom wall 78 has a plurality of pins 80 extending downwardly through it, with the same being aligned so as to be received within the bores formed in the rivet 22. Accordingly, it can be seen that when the walled container or box 72 is disposed atop the pallet 10 with the pins 80 extending into the bores in the rivets 22, the pins function to retain the walled container or box 72 on the pallet.

Figure 12:
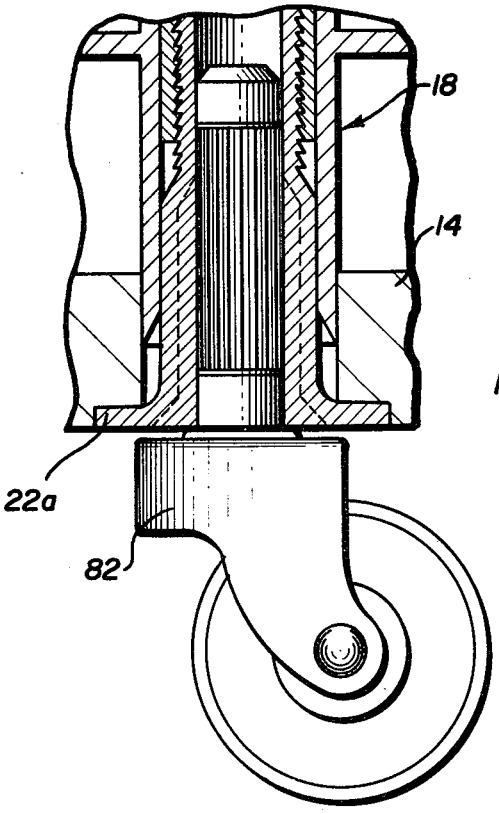
FIG. 12 is a partial sectional view generally illustrating the manner in which a caster or casters are affixed to a pallet constructed in accordance with the present invention.

In FIG. 12, in the event it should be desired to affix a plurality of casters, such as the caster 82, beneath the pallet, it can be seen that the caster pins 83 can be frictionally and forcibly inserted within the bores in the rivets 22, to affix the casters to the pallet. By affixing at least four of such casters to a pallet, it is apparent that the pallet can be easily transported by simply rolling it.

The exterior surface of the post and the interior surface of the sleeve may be provided with surfaces which create functional engagement to restrict rotation of the sleeve, in instances where a constant pressure is asserted against the sleeve. Such an arrangement may be advantageous when using the pallets in a gravity flow type conveyor system.

It will thus be seen that the objects set forth above, among those made apparent from the preceding description, are efficiently attained and certain changes may be made in the above article. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A pallet comprising at least an upper platform and a plurality of posts for supporting said upper platform in spaced relationship to a support surface, said upper platform having formed therein a number of holes corresponding in number to the posts secured thereto, said posts each comprising an outer body and a smaller inner body encompassed by said outer body and attached to said outer body by a plurality of spaced apart flanges, said inner body having a portion extending beyond said outer body at at least one end thereof and having an axially aligned bore extending through it, the extended portion of said inner body being disposed within the respective ones of said holes in said upper platform, and a plurality of rivets each having an enlarged diameter base portion and an axially aligned cylindrical shaft portion formed integrally therewith, said cylindrical shaft portion of each said rivet being extended through a respective one of said holes in said upper platform and into said bore in said inner body of a corresponding post to fixedly and replaceably secure each said post to said upper platform.

2. The pallet of claim 1, further comprising complimentary interlocking means on said cylindrical shaft portion of each of said rivets and on the side wall of said bore in each of said inner bodies which interlock to secure said posts to said upper platform of said pallet.

3. The pallet of claim 2, wherein said outer body of each said post is cylindrical-shaped, a cylindrical-shaped hollow roller disposed about each said outer body and freely rotatably retained thereon, each of said outer bodies having an enlarged diameter base portion with a diameter larger than the diameter of said roller for rotatably retaining said roller disposed about said outer body between said upper platform and said enlarged diameter base portion.

4. The pallet of claim 2, wherein each of said posts is integrally molded of plastic and comprises a generally hollow, cylindrical-shaped outer body, a smaller cylindrical-shaped inner body and a plurality of radially extending support flanges securing said inner body in axial alignment within said outer body, a bore extending through said inner body for receiving therein said cylindrical shaft portion of one said rivets for securing said post to said upper pallet, said rivet being integrally molded of plastic.

5. The pallet of claim 1, wherein each of said rivets comprises a male rivet portion and a female rivet portion having complimentary interlocking means thereon for fixedly securing said male and female rivet portions together, a cylindrical-shaped roller rotatably disposed about said outer body of each of said posts and having a length which is shorter than the length of said cylindrical-shaped outer body of said post, one of said male and female rivet portions of each of said rivets having an enlarged diameter base portion which is larger in diameter than the diameter of said cylindrical-shaped rollers, whereby said base portion rotatably retains said roller on and rotatably about said outer body of said post, each of said posts functioning as a spacer for its associated one of said rollers when said post is secured to said upper platform by means of one of said male and female rivet portions being extended through one of said holes in said upper platform and into said bore in said inner body and the other one thereof having said enlarged base portion being extended into the opposite end of said bore in said inner body and into interlocking engagement with said one of said male and female rivet portions extended through said hole in said upper platform and into said bore in said inner body.

6. The pallet of claim 5, wherein said male and female rivet portions of each of said rivets have an axial bore extending through them.

7. The pallet of claim 6, further comprising a walled container having side walls and a bottom wall, a plurality of pins affixed to said bottom wall in positional alignment with the bore in said rivet portions, whereby said walled container can be removably affixed to said pallet against accidental dislodgment by extending said pins into said bores in said rivet portions.

8. The pallet of claim 7, further comprising casters having shafts extended into said bores in said rivet portions, whereby casters can be removably affixed to the pallet.

9. The pallet of claim 1, further comprising a lower platform having formed therein a corresponding number of holes aligned with said holes in said upper platform, said plurality of posts being disposed between said upper and lower platforms for securing them together in spaced apart relationship, said inner body of each said post having a portion extending beyond said outer body at each end thereof, the extended portions of said inner bodies being disposed within the respective ones of said aligned holes in said upper and lower platforms respectively, and a rivet extending through each of said aligned holes formed in the respective upper and lower platforms and into said bore in said inner body of the respective ones of said posts to secure said upper and lower platforms to said plurality of posts.

10. The pallet of claim 9, wherein said bore in said inner body of the respective ones of said posts and the cylindrical shaft portions of said rivets have complimentary interlocking means thereon for fixedly securing said cylindrical shaft portions within said bore.

11. The pallet of claim 9, wherein said rivets comprise a male rivet portion and a female rivet portion with complimentary interlocking means which lockingly engage when said male rivet portion is disposed within said female rivet portion.

12. The pallet of claim 9, wherein each of said posts is integrally molded of plastic and comprises a generally hollow, cylindrical-shaped outer body, a smaller cylindrical-shaped inner body and a plurality of radially disposed support flanges securing said inner body in axial alignment within said outer body, a bore extending through said inner body, and a pair of rivets associated with each of said posts, each of said pair of rivets having an enlarged diameter base portion and a cylindrical-shaped shaft portion, said cylindrical-shaped shaft portions each being extended through a respective one of said aligned holes in the respective ones of said upper and lower platforms and into said bore in said inner body of the post with which it is associated for securing said upper and lower platforms to said posts.

13. The pallet of claim 12, wherein said bore in said inner body of the respective ones of said posts and said cylindrical-shafted portions of said rivets associated with said posts have complimentary interlocking means for lockingly securing said cylindrical-shaped shaft portions within said bore.

14. The pallet of claim 13, wherein each of said pairs of rivets comprise a male rivet portion and a female rivet portion having complimentary interlocking means which lockingly engage to secure said upper and lower platforms to said posts when said male rivet portion is engaged within said female rivet portion.

15. The pallet of claim 9, further comprising a cylindrical-shaped roller rotatably disposed about each of said posts, said roller having a length shorter than the length of said post whereby said post functions as a spacer.

16. A roller post for use in combination with a pallet having at least an upper platform with a plurality of holes formed in it, said roller post comprising, in combination, a post having an outer body and a smaller inner body encompassed by said outer body and attached to said outer body by a plurality of spaced apart flanges, said inner body having a portion extending beyond said outer body at at least one end thereof and having an axially aligned bore extending through it, the extended portion of said inner body being disposable within the respective ones of said holes in said upper platform, and a rivet having an enlarged diameter base portion and a cylindrical shaft portion formed integrally therewith, said cylindrical shaft portion being proportioned to extend through a respective one of said holes in said upper platform and into said bore in said inner body of said post to fixedly and replaceably secure said post to said upper platform.

17. The roller post of claim 16, further comprising complimentary interlocking means on said cylindrical shaft portion of said rivet and on the side wall of said bore in said inner body which interlock to secure said post to said upper platform of said pallet.

18. The roller post of claim 18, wherein said outer body of said post is cylindrical-shaped, a cylindrical-shaped hollow roller disposed about said outer body and freely rotatably retained thereon, said outer body having an enlarged diameter base portion with a diameter larger than the diameter of said roller for rotatably retaining said roller disposed about said outer body between said upper platform and said enlarged base portion.

19. The roller post of claim 18, wherein said post is integrally molded of plastic and comprises a generally hollow, cylindrical-shaped outer body, a smaller cylindrical-shaped inner body and a plurality of radially extending support flanges securing said inner body in axial alignment within said outer body, a bore extending through said inner body for receiving therein said cylindrical shaft portion of said rivet for securing said post to said upper platform, said rivet being integrally molded of plastic.

20. The roller post of claim 18, wherein said rivet comprises a male rivet portion and a female rivet portion having complimentary interlocking means thereof for fixedly securing said male and female rivet portions together, a cylindrical-shaped roller rotatably disposed about said outer body of said post and having a length which is shorter than the length of said cylindrical-shaped outer body of said post, one of said male and female rivet portions having an enlarged diameter base portion which is larger in diameter than the diameter of said cylindrical-shaped roller, whereby said base portion rotatably retains said roller on and rotatably about said outer body of said post, said post functioning as a spacer for said roller when said post is secured to said upper platform by means of one of said male and female rivet portions being extended through said hole in said upper platform and into said bore in said inner body and the other one thereof having said enlarged base portion being extended into the opposite end of said bore in said inner body and into interlocking engagement with said one of said male and female rivet portions extended through said hole in said upper platform and into said bore in said inner body.

21. The roller post of claim 18, wherein said pallet further includes a lower platform having formed therein a corresponding number of holes aligned with said holes in said upper platform, said post being disposed between said upper and lower platforms for securing them together in spaced apart relationship, said inner body of said post having a portion extending beyond said outer body at each end thereof, the extended portions of said inner bodies being disposed within the respective ones of said aligned holes in said upper and lower platforms respectively, and a rivet extending through each of said aligned holes formed in the respective upper and lower platforms and into said bore in said inner body of said post to secure said upper and lower platforms to said post.

22. The roller post of claim 21, wherein said bore in said outer body of of said post and the cylindrical shaft portions of said rivets have complimentary interlocking means thereof for fixedly securing said cylindrical shaft portions within said bore.

23. The roller post of claim 21, wherein said rivets comprise a male rivet portion and a female rivet portion with complimentary interlocking means which lockingly engage when said male rivet portion is disposed within said female rivet portion.

24. The roller post of claim 21, wherein said post is integrally molded of plastic and comprises a generally hollow, cylindrical-shaped outer body, a smaller cylindrical-shaped inner body and a plurality of radially disposed support flanges securing said inner body in axial alignment within said outer body, a bore extending through said inner body, a pair of rivets each having an enlarged diameter base portion and a cylindrical-shaped shaft portion, said cylindrical-shaped shaft portions each being extended through one of said holes in the respective ones of said upper and lower platforms and into said bore in said inner body for securing said upper and lower platforms to said post.

25. The roller part of claim 24, wherein said bore in said inner body and said cylindrical-shafted portions of said rivets have complimentary interlocking means for lockingly securing said cylindrical-shaped shaft portions within said bore.

26. The roller post of claim 24, wherein said pair of rivets comprise a male rivet portion and a female rivet portion having complimentary interlocking means which lockingly engage to secure said upper and lower platforms to said posts when said male rivet portion is engaged within said female rivet portion.

27. The roller post of claim 21, further comprising a cylindrical-shaped roller rotatably disposed about said post, said roller having a length shorter than the length of said post whereby said post functions as a spacer.

* * * * *